US011565921B2

(12) United States Patent
Sperlich et al.

(10) Patent No.: US 11,565,921 B2
(45) Date of Patent: Jan. 31, 2023

(54) LOW-LIFT INDUSTRIAL TRUCK AND METHOD FOR OPERATING THE SAME

(71) Applicant: Jungheinrich AG, Hamburg (DE)

(72) Inventors: Enrico Sperlich, Leipzig (DE); Marko Kral, Halle (DE)

(73) Assignee: Jungheinrich AG, Hamburg (DE)

( * ) Notice: Subject to any disclaimer, the term of this patent is extended or adjusted under 35 U.S.C. 154(b) by 447 days.

(21) Appl. No.: 16/824,760

(22) Filed: Mar. 20, 2020

(65) Prior Publication Data

US 2020/0299117 A1 Sep. 24, 2020

(30) Foreign Application Priority Data

Mar. 20, 2019 (DE) ..... 10 2019 107 096.1

(51) Int. Cl.
*B66F 9/075* (2006.01)
*B66F 9/12* (2006.01)

(52) U.S. Cl.
CPC ..... *B66F 9/0755* (2013.01); *B66F 9/12* (2013.01)

(58) Field of Classification Search
CPC ..... B66F 9/0755; B66F 9/12; B66F 9/24
See application file for complete search history.

(56) References Cited

U.S. PATENT DOCUMENTS 4,747,610 A 5/1988 Yingling et al.
2007/0215412 A1* 9/2007 Fossier ..... B66F 9/0755 187/222
2011/0234389 A1* 9/2011 Mellin ..... B66F 9/0755 340/435
2017/0349197 A1 12/2017 Jonasson et al.
2019/0194005 A1* 6/2019 Shah ..... G05D 1/024
2019/0196480 A1* 6/2019 Taylor ..... G05D 1/0088

FOREIGN PATENT DOCUMENTS

DE 20115380 U1 2/2003
EP 1293472 A2 * 3/2003 ..... B66F 17/003
EP 3165422 A1 * 5/2017 ..... B62B 3/06
EP 3369696 A1 * 9/2018 ..... B62B 3/0618
KR 20180002432 A1 * 1/2018 ..... B66F 9/12

* cited by examiner

*Primary Examiner* — Genna M Mott

(74) *Attorney, Agent, or Firm* — Rankin, Hill & Clark LLP

(57) ABSTRACT

A low-lift industrial truck (2) and a method for operating the same. The industrial truck includes a load fork (4) for picking up a load. Fork tines (6*a*, 6*b*) of the load fork (4) each include at least one load roller (8) in a region of fork tine tips (28). The industrial truck also includes a load lifting assistance system having a distance sensor (16) and a processing unit (14). The distance sensor is configured to measure a distance between the load and a front wall (12) of the industrial truck facing the load fork. At least one distance between the load and the front wall is saved in the processing unit and corresponds to a predetermined stop position. The processing unit is configured to process measured values of the distance sensor and to generate a stop signal when a distance corresponding to the stop position (20*a*, 20*b*) is determined.

18 Claims, 6 Drawing Sheets

LOW-LIFT INDUSTRIAL TRUCK AND METHOD FOR OPERATING THE SAME

PRIORITY CLAIM

The present application claims priority to DE 10 2019 107 096.1, filed Mar. 20, 2019, which is hereby incorporated by reference in its entirety.

BACKGROUND OF INVENTION

Field of Invention

The invention relates to a low-lift industrial truck having a load fork for picking up a load, wherein the fork tines of the load fork each comprise at least one load roller in the region of the fork tine tips. Furthermore, the invention relates to a method for operating a low-lift industrial truck having a load fork for picking up a load, wherein the fork tines of the load fork each comprise at least one load roller in the region of the fork tine tips.

Brief Description of Related Art

Pallets on which a load is located are frequently moved with low-lift industrial trucks, wherein the pallet can optionally be picked up in the longitudinal direction (pallet longitudinal insertion) or in the transverse direction (pallet transverse insertion). Depending on the pallet pickup direction, different fork insertion depths are needed in order to pick up the pallet so that it is not damaged during the lifting process. This is especially necessary when the pallet is picked up transversely.

In order to ensure that the pallet is not damaged, the operator of the industrial truck must position the fork so that the pallet stops at a fork mark on the fork. If this is the case, the load rollers in the region of the fork tine tips are located in the gap between the wood planks of the pallet. If the industrial truck is positioned incorrectly relative to the pallet, the load rollers may be located on the floor boards of the pallet. In this state, an attempt to lift off the pallet may destroy the pallet since the distance between the load rollers and the top of the fork tines increases while lifting off. This also holds true in the event that the pallet is picked up transversely. If the pallet is picked up longitudinally, the fork tines, while being inserted into the pallet, are completely inserted thereinto. However, in many cases during this process, one or more strong collisions occur between the pallet and a front wall of the industrial truck facing the fork. This collision can lead to damage of the pallet itself, the load on the pallet, or the industrial truck.

Consequently, the user of the industrial truck must always watch the fork mark while inserting the load fork, which however is not always possible for various reasons. An exposed view of the fork mark does not always prevail, for example. The reason for this may be the height of the operator, the battery height or the fork length. Frequently, the load-lifting fork of industrial trucks is also soiled to a greater or lesser degree so that the fork mark is difficult to discern.

Picking up a pallet with a low-lift industrial truck is therefore always a process that requires high concentration on the part of the operator of the industrial truck. Given the subjective assessment on the part of the operator that is always necessary and the resulting potential incorrect positioning, there is always a risk of damaging the pallet, the load or the industrial truck.

It is an object of the invention to provide a low-lift industrial truck and a method for operating a low-lift industrial truck, wherein picking up a pallet is simplified for the operator of the industrial truck.

BRIEF SUMMARY OF THE INVENTION

The object is achieved by a low-lift industrial truck having a load fork for picking up a load, wherein the fork tines of the load fork each comprise at least one load roller in the region of the fork tine tips, wherein this low-lift industrial truck is developed by a load lifting assistance system that comprises a distance sensor and a processing unit, wherein the distance sensor is configured to measure a distance between the load and a front wall of the industrial truck facing the load fork, and at least one distance between the load and the front wall is saved in the processing unit and corresponds to a predetermined stop position, wherein the processing unit is configured to process measured values of the distance sensor and to generate a stop signal when a distance corresponding to the stop position can be determined.

By determining the distance of the load from the front wall of the industrial truck, i.e., the position of the load on or also in front of the load fork, and the reaction of the industrial truck resulting therefrom, a collision of the front wall of the industrial truck with the load or the pallet on which the load is located can advantageously be prevented. The operator of the industrial truck is unburdened in that he no longer has to permanently watch a fork mark while inserting the load fork into the pallet in order to ensure the correct loading by the load fork. This makes it much easier for the operator to pick up the pallet. The normally required visual monitoring including the subjective assessment by the operator is advantageously discarded. Since a collision of the pallet, or respectively the load, with the front wall of the industrial truck can be avoided or at least significantly attenuated especially while pallet longitudinal insertion, damage to the goods, the pallet or the industrial truck can be minimized or completely prevented.

An ultrasonic sensor, a laser rangefinder or a radar rangefinder as well can for example be used. The distance sensor is for example positioned in the front wall of the industrial truck. At least the distance sensor is positioned on the industrial truck so that it is capable of determining the longitudinal position of the load on the load fork.

In the context of the present specification, an industrial truck is always to be understood as a low-lift industrial truck even if it is not explicitly identified in this way and for example is only termed an "industrial truck".

According to an advantageous embodiment, the industrial truck is developed in that when the stop signal is present, the processing unit is configured to output an alert signal to an acoustic and/or visual output unit, and/or to stop the industrial truck, and in particular to then automatically lift the load fork.

The generated acoustic and/or visual alert signal that is output by the output unit alerts the operator of the industrial truck that the pallet with the load is in the correct position so that the load fork can then be lifted. Advantageously, this process occurs at the moment in which the industrial truck has automatically come to a complete standstill. This function unburdens the operator and increases the handling capacity of the industrial truck. This is further improved when the industrial truck according to the aforementioned embodiment additionally automatically lifts the load fork. The industrial truck stops so that the load fork is inserted into the pallet up to the stop position. Once the industrial truck reaches the stop position, the load fork is automatically lifted, i.e., independently and without user input being necessary. To accomplish this, a corresponding brake characteristic is saved in the processing unit for example. In particular, it is furthermore provided for various pallet types to define individual stop positions, and to save individual brake characteristics in the processing unit. According to such an embodiment, the industrial truck is furthermore configured, for example, to optionally independently recognize the picked up pallet type, for example with the assistance of a camera and a suitable image processing system saved in the processing unit, or to receive corresponding user input.

According to an advantageous embodiment, the industrial truck is developed in that an acceleration sensor is comprised which is configured to measure a vertical acceleration of the load fork in the region of at least one fork tine tip, wherein the processing unit is configured to process measured values of the acceleration sensor and to detect a vertical acceleration event, and wherein a first distance of a first stop position for pallet transverse insertion and a second distance of a second stop position for pallet longitudinal insertion are saved in the processing unit, wherein the processing unit is furthermore configured to generate the stop signal at the second stop position when a distance is detectable that is less than or equal to a distance of the first stop position, and a vertical acceleration event was undetectable.

Advantageously, the industrial truck according to this embodiment is configured to differentiate between a pallet transverse insertion and a pallet longitudinal insertion. With pallet transverse insertion, a vertical acceleration event occurs at the moment in which the load rollers traverse the plank, for example a wood plank, of the pallet. Such a vertical acceleration event is for example a vertical acceleration measured by the acceleration sensor that lies above a set threshold value, and reliably indicates the vibration, or respectively the shock when traversing the planks. If such a vertical acceleration event does not occur upon reaching the first stop position, it can be deduced from this that it constitutes a pallet longitudinal insertion. In this case, the second stop position can be chosen as the stop position, i.e., the one for pallet longitudinal insertion.

The distance between the front wall of the industrial truck and the stop position for pallet longitudinal insertion is less than the distance to the stop position for pallet transverse insertion.

The industrial truck significantly unburdens the operator since the each appropriate stop position is established as the set stop position at which the stop signal is generated depending on if a pallet transverse insertion or a pallet longitudinal insertion occurs. This ensures that the load fork is always correctly positioned both during pallet longitudinal insertion as well as during pallet transverse insertion, and damage to the pallet is prevented while lifting the load fork. Advantageously, it is no longer necessary to keep a fork mark in sight by visual monitoring during pallet insertion, to distinguish between longitudinal insertion and transverse insertion, and moreover to correspondingly position the load at the associated fork mark. The industrial truck automatically takes care of this process for the operator.

The industrial truck is furthermore for example developed in that at least one set acceleration parameter characteristic for the vertical acceleration event is saved in the processing unit, wherein the processing unit is configured to detect a vertical acceleration event when at least one of the acceleration parameters is exceeded. For example a limit value for the acceleration is saved as the acceleration event. If a vertical acceleration is measured whose value lies above this limit value, a vertical acceleration event can be deduced therefrom. It is also provided that for example a characteristic curve of the acceleration, as occurs when traversing a plank, is saved as the vertical acceleration event. For example, this is two temporally sequential acceleration events: a first one when moving toward the plank, and a second, possibly stronger one when lowering the load roller off the plank.

According to another advantageous embodiment, the industrial truck is developed in that a second detection zone is saved in the processing unit and extends, at least sectionally, in the fork direction between the first stop position and the fork tine tips. In other words, the second detection zone lies between the fork tine tips and the first stop position, wherein it takes up both the entire region or also only a section between the first stop position and the fork tine tips. It is furthermore provided for the processing unit to be configured to detect and process measured values of the acceleration sensor when it can be determined that the load is located within the second detection zone with reference to the measured distance of the load. The unnecessary evaluation of acceleration values is avoided by intentionally detecting the acceleration values exclusively within a state in which the load is located within the second detection zone. The reliability with which a vertical acceleration event can be detected is therefore improved.

According to an advantageous embodiment, it is provided that the load rollers lie at least sectionally within the second detection zone, and/or the second detection zone in the fork direction has a length greater than or equal to 227 mm. Since the second detection zone is arranged so that the load rollers lie within the detection zone, it can be ensured that the vibration event is detected in every case when the load rollers traverse a plank. An extent of the second detection zone, more precisely a length in the fork direction, above the indicated value has proven to be advantageous in practice.

According to another advantageous embodiment, the industrial truck is developed in that a third detection zone is saved in the processing unit and extends in the fork direction starting from a minimum distance to the front wall, wherein the predetermined stop position lies within the third detection zone, and wherein the processing unit is furthermore configured to limit a driving speed of the industrial truck to a predetermined second value when it can be determined that the load is within the third detection zone with reference to the measured distance of the load.

In particular, the driving speed of the industrial truck is reduced relative to a nominal speed in handling mode, which means that the predetermined first value of the driving speed lies below the nominal speed of the industrial truck in handling mode. This ensures that the load fork is not inserted into the pallet at too high a speed. This is important and advantageous especially for pallet transverse insertion since the load rollers in the region of the fork tine tips traverse the wood planks of the pallet. To prevent damage to the pallet, the goods and the industrial truck, this may not be done at too high a speed.

According to another advantageous embodiment, the industrial truck is developed in that a third detection zone is saved in the processing unit and extends in the fork direction starting from a minimum distance to the front wall, wherein the predetermined stop position lies within the third detection zone, and wherein the processing unit is furthermore configured to limit a driving speed of the industrial truck to a predetermined second value when it can be determined that the load is within the third detection zone with reference to the measured distance of the load.

If the presence of the load in the third detection zone is detected with reference to the distance from the front wall of the industrial truck, i.e., its longitudinal position on the load fork, the driving speed of the industrial truck is further reduced. The second value of the driving speed is in particular less than the aforementioned first value of the driving speed. This ensures that the industrial truck can reliably and safely come to a stop at the first, or respectively second stop position, and the pallet with the load can be correctly picked up. The probability of a collision between the load or pallet and the front wall of the industrial truck and accordingly the probability of damaging the pallet during the lifting process is further reduced.

The object is also solved by a method for operating a low-lift industrial truck having a load fork for picking up a load, wherein the fork tines of the load fork each comprise at least one load roller in the region of the fork tine tips, wherein this method is developed in that a load is picked up with the load fork and a distance is measured by a distance sensor between the load and a front wall of the industrial truck facing the load fork, wherein at least one distance between the load and the front wall is saved that corresponds to a predetermined stop position, wherein measured values of the distance sensor are processed and a stop signal is generated when a distance corresponding to the stop position is determined.

The same or similar advantages apply to the method for operating the low-lift industrial truck that were mentioned above with reference to the industrial truck itself, and they will therefore not be repeated.

The method is in particular further developed in that, when the stop signal is present, an alert signal is output in an acoustic and/or visual output unit, and/or the industrial truck is stopped, and in particular the load fork is then automatically lifted.

According to an embodiment, the method furthermore provides that the industrial truck comprises an acceleration sensor with which a vertical acceleration of the load fork is measured in the region of at least one fork tine tip, wherein a first distance of a first stop position for pallet transverse insertion and a second distance of a second stop position for pallet longitudinal insertion are saved, and when a distance is detected that is less than or equal to a distance of the first stop position, and a vertical acceleration event was not detected, the stop signal is generated at the second stop position.

The method is furthermore for example further developed in that at least one set acceleration parameter characteristic for the vertical acceleration event is saved, wherein a vertical acceleration event is detected when at least one of the acceleration parameters is exceeded.

According to an advantageous embodiment, the method is further developed in that a second detection zone is saved that extends, at least sectionally, in the fork direction between the first stop position and the fork tine tips, wherein measured values of the acceleration sensor are detected and processed with respect to the presence of a vertical acceleration event when it is determined that the load is located within the second detection zone with reference to the measured distance of the load.

Furthermore, it is provided that the load rollers lie at least sectionally within the second detection zone, and/or the second detection zone in the fork direction (GR) has a length greater than or equal to 227 mm.

The method is furthermore further developed in particular in that a first detection zone is saved that extends in the fork direction starting from the fork tine tips up to a first limit that lies at a safety distance in front of the fork tine tips, and when a distance is measured that lies within the first detection zone, a driving speed of the industrial truck is limited to a predetermined first value.

According to another advantageous embodiment, the method is further developed in that a third detection zone is saved that extends in the fork direction starting from a minimum distance to the front wall, wherein the predetermined stop position lies within the third detection zone, and a driving speed of the industrial truck is limited to a predetermined second value when a distance of the load is determined that lies within the third detection zone.

Additional features of the invention will become apparent from the description of embodiments according to the invention together with the claims and the attached drawings. Embodiments according to the invention can fulfill individual features or a combination of several features.

In the scope of the invention, features which are designated by "in particular" or "preferably" are understood to be optional features.

BRIEF DESCRIPTION OF THE DRAWINGS

The invention is described below, without restricting the general idea of the invention, based on exemplary embodiments in reference to the drawings, whereby we expressly refer to the drawings with regard to all details according to the invention that are not explained in greater detail in the text. In the figures:

FIG. 3*b*, 3*d* show schematically simplified side views of a pallet from different directions, wherein FIG. 3*b* shows a longitudinal side, and FIG. 3*d* shows a transverse side of the pallet.

In the drawings, the same or similar elements and/or parts are provided with the same reference numbers in each case; a reintroduction will therefore always be omitted.

DETAILED DESCRIPTION OF THE INVENTION

Figure 1:
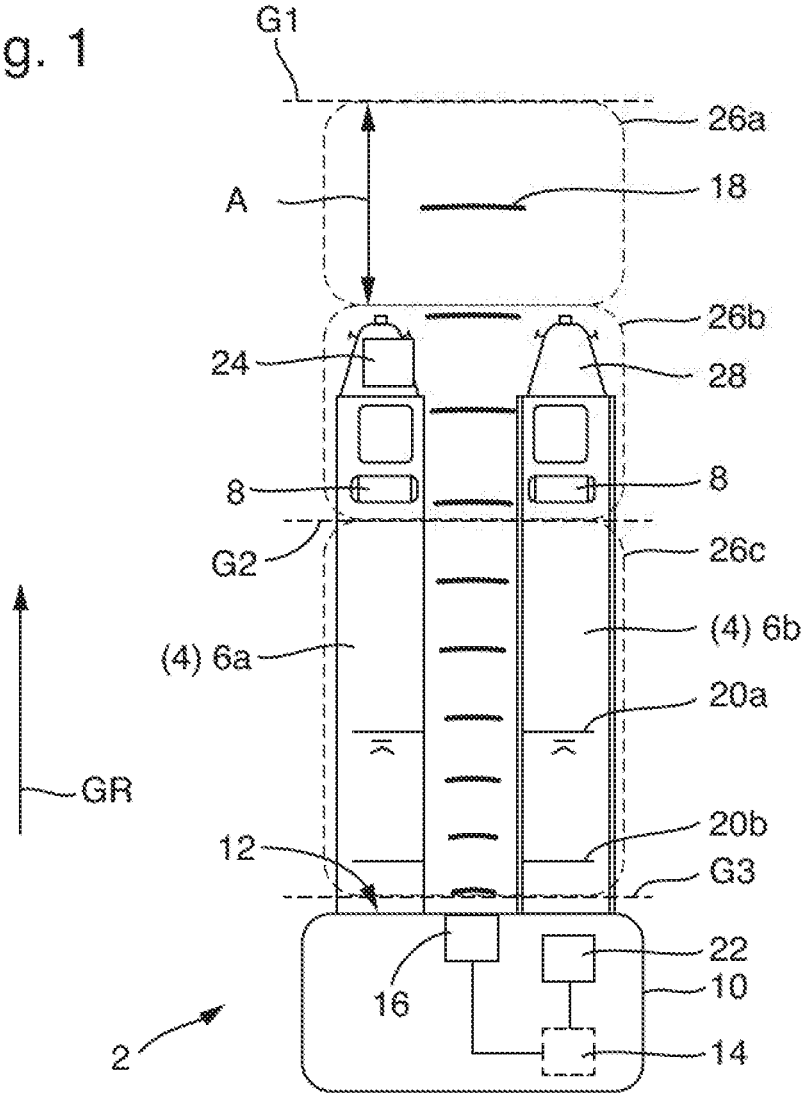
FIG. 1 shows a schematically simplified plan view of an industrial truck that represents the three provided detection zones.

FIG. 1 shows a schematically simplified plan view of a low-lift industrial truck 2 which will also be generally termed an industrial truck in the context of the present description. This comprises a load fork 4 for picking up a load (not shown). The load is, for example, a commodity arranged on a pallet (also not shown), wherein the pallet together with the commodity is considered the load. The load fork 4 comprises two fork tines 6*a*, 6*b* that each for example comprise a load roller 8 in the region of the respective fork tine tip 28. It is also provided that a plurality of load rollers 8 are on the fork tine tips 28.

The industrial truck 2 furthermore comprises a housing 10 on which are operating elements (not shown) for operating the industrial truck 2. The housing 10 comprises a front wall 12 facing the load fork 4. Within the housing 10 is a processing unit 14, wherein it is for example a computer, microcontroller or the like. It is also provided that the processing unit 14 is implemented as part of the control of the industrial truck 2. The processing unit 14 is coupled to a distance sensor 16 via a data link. The distance sensor 16 is for example an ultrasonic sensor, a laser rangefinder or a radar rangefinder as well. For example, the distance sensor 16 is positioned in the front wall 12 of the housing 10 of the industrial truck 2.

The distance sensor 16 is configured to measure a distance between the load and the front wall 12 of the industrial truck 2 facing the load fork 4. This is indicated schematically and as an example by the schematically portrayed shaft fronts 18. The measured values detected by the distance sensor 16 are forwarded to the processing unit 14 which is configured to process these measured values from the distance sensor 16 and determine a distance of the load from the front wall 12 of the industrial truck 2 from them. To the extent that the load is already on the load fork 4 of the industrial truck 2, a longitudinal position of the load on the load fork 4 can be determined from the distance.

Furthermore, two stop positions are defined, for example: A first stop position 20*a* for pallet transverse insertion, and a second stop position 20*b* for pallet longitudinal insertion. These stop positions 20*a*, 20*b* serve to correctly position the pallet on the load fork 4 so that it can be lifted with the load fork 4 without damaging the pallet. Moreover, a collision of the load with the front wall 12 of the industrial truck 2 is avoided. Conventionally, the stop positions are fork marks that are on the load fork 4 and are monitored by the operator of the industrial truck during the pickup process by visual monitoring. With the industrial truck 2 according to the described exemplary embodiment, the stop positions 20*a*, 20*b* are saved in the processing unit 14. The processing unit 14 is furthermore configured to generate a corresponding stop signal when a value is measured with the distance sensor 16, from which it is deducible that the load is located at one of the stop positions 20*a*, 20*b*.

The processing unit 14 is furthermore configured to output an alert signal, for example, when the stop signal is present. This is accomplished for example by an acoustic and/or visual output unit 22. For example, a light signal or a display is generated that indicates to the operator of the industrial truck 2 that the load is at the relevant stop position 20*a*, 20*b*, or an acoustic alert signal sounds. The processing unit 14 is furthermore configured for example to stop the industrial truck 2 when one of the stop positions 20*a*, 20*b* has been reached. Furthermore, the industrial truck 2, or respectively its processing unit 14, is configured to automatically lift the load fork 4 when the relevant stop position 20*a*, 20*b* has been reached.

Which of the two stop positions 20*a*, 20*b* are relevant for generating the stop signal depends on whether a pallet transverse insertion or a longitudinal insertion is occurring. The industrial truck 2 is capable of determining the type of insertion. In this regard, the industrial truck 2 comprises an acceleration sensor 24 that is configured to measure a vertical acceleration of the load fork 4 in the region of the fork tine tip 28. Since the load rollers 8 traverse a plank, for example a wood plank, of the pallet during the pallet transverse insertion, a vibration event occurs in the region of the fork tine tips 28. This vertical acceleration event that arises from the vibration, or respectively the shock in the region of the load rollers 8 when traversing the wood planks, alerts the industrial truck 2 to the fact that a pallet transverse insertion is occurring. Accordingly, the first stop position 20*a* relevant for the pallet transverse insertion is the stop position at which the stop signal is generated.

In order to establish whether it is a pallet transverse insertion or a pallet longitudinal insertion, the processing unit 14 of the industrial truck 2 not only detects whether a vertical acceleration event is occurring, it also measures the distance between the front wall 12 and the load with the assistance of the distance sensor 16. The type of pallet insertion can be determined from these two parameters, and the stop position appropriate for the type of pallet insertion can be selected.

If for example a distance value is detected that is less than or equal to a distance to the first stop position 20*a*, while at the same time a vertical acceleration event was not detected during insertion into the pallet, this means that the load rollers 8 have not traversed a plank of the pallet. Consequently, it must be a pallet longitudinal insertion, and the relevant stop position is therefore the second stop position 20*b*. Accordingly, the industrial truck 2 is stopped at the second stop position 20*b*, or a corresponding alert signal is output.

For example, a plurality of detection zones are saved in the processing unit 14, i.e., a first detection zone 26*a*, a second detection zone 26*b*, and a third detection zone 26*c*.

The first detection zone 26*a* extends in the fork direction GR starting from the fork tine tips 28 up to a first limit G1. The first limit G1 is at a safety distance A in front of the fork tine tips 28. The processing unit 14 is configured to limit the driving speed of the industrial truck 2 to a predetermined first value when a measured distance between the front wall 12 of the industrial truck 2 and the load lies within the first detection zone 26*a*. The industrial truck 2 is braked in other words when it approaches the load and the load is within the first detection zone 26*a* and only moves further at a reduced speed. The first value of the driving speed is less than a value of the routine or normal driving speed of the industrial truck 2 in handling mode.

The second detection zone 26*b* extends in the fork direction GR, wherein the load rollers 8 lie at least sectionally within the second detection zone 26*b*. In the portrayed exemplary embodiment, the second detection zone 26*b* extends from a second limit G2 in the fork direction GR up to the fork tine tips 28. For example, the second detection zone 26*b* ends opposite the fork direction GR shortly or directly after the load rollers 8. In the portrayed exemplary embodiment, the load rollers 8 lie completely within the second detection zone 26*b*. The second detection zone 26*b* extends in particular up to the first detection zone 26*a*, and the transition between the first detection zone 26*a* and the second detection zone 26*b* lies within the region of the fork tine tips 28, for example at the outer end of the fork tine tips 28, or shortly before as in the portrayed exemplary embodiment.

The processing unit 14 is furthermore configured, for example, to detect and process measured values of the acceleration sensor 24 when a position of the load is determined with reference to the measured value of the longitudinal position that lies within the second detection zone 26*b*. In the event that a vertical acceleration event is detected that for example is triggered by traversing the planks of a pallet, the first stop position 20*a* for pallet transverse insertion is established as the stop position. If there is no vertical acceleration event, the second stop position 20*b* is established as the stop position for pallet longitudinal insertion.

The third detection zone 26*c* extends in the fork direction GR starting from a minimum distance to the front wall 12, wherein the predetermined stop position, i.e., the first stop position 20*a* for pallet transverse insertion and the second stop position 20*b* for pallet longitudinal insertion, lies within the third detection zone 26*c*. In the portrayed exemplary embodiment, the third detection zone 26*c* extends from a third limit G3 in the fork direction GR up to the second limit G2. The third limit G3 is determined so that the minimum distance between the third limit G3 and the front wall 12 of the industrial truck 2 is maintained. The predetermined stop positions 20*a*, 20*b* lie within the third detection zone 26*c*. The processing unit 14 is configured to determine a position of the load with reference to the measured value of the longitudinal position and, to the extent that it lies within the third detection zone 26*c*, to further reduce the driving speed of the industrial truck 2, i.e., to a second predetermined value. The second predetermined value for the driving speed lies below the aforementioned first value, which means that the driving speed of the industrial truck 2 is further reduced. This serves to prevent a collision of the load with the front wall 12 of the industrial truck 2 and to allow the industrial truck 2 to reliably and safely stop at the respectively relevant stop position 20*a*, 20*b*.

Figure 2:
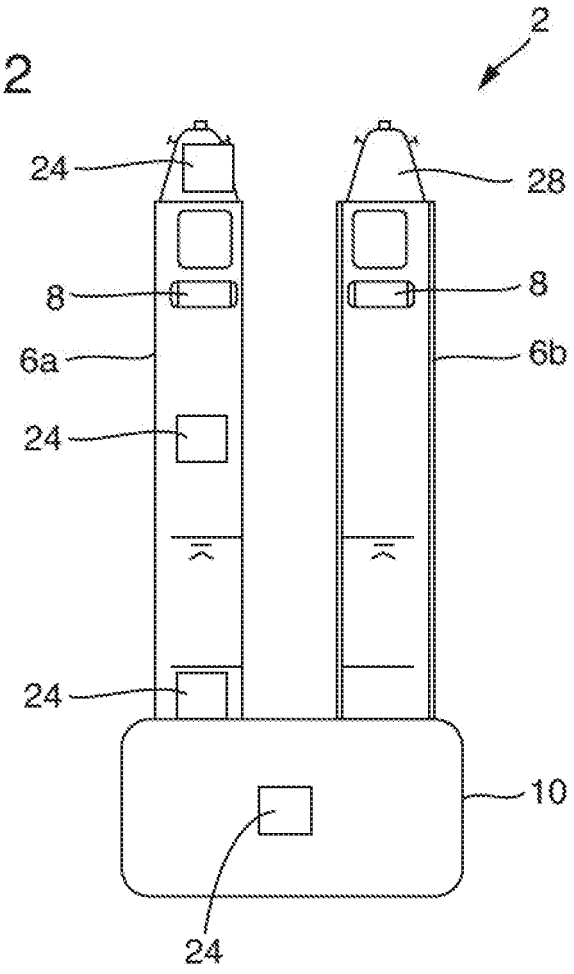
FIG. 2 shows a schematically simplified plan view of an industrial truck, wherein potential positions are represented by way of example for the acceleration sensor.

FIG. 2 shows a further schematically simplified plan view of the industrial truck 2. For example, the possible positions are shown for the acceleration sensor 24. As already mentioned in conjunction with FIG. 1, the acceleration sensor 24 can be arranged in the region of the fork tine tip 28. It is however also provided that this is located within the fork tine 6*a* or 6*b*, and an arrangement in the rear region of the fork tines 6*a*, 6*b* is also possible. Since the vibration frequently continues into the housing 10 of the industrial truck 2 when traversing the wood plank of the pallet, it is also provided that the acceleration sensor 24 can be arranged in the region of the housing 10.

Figure 3A:
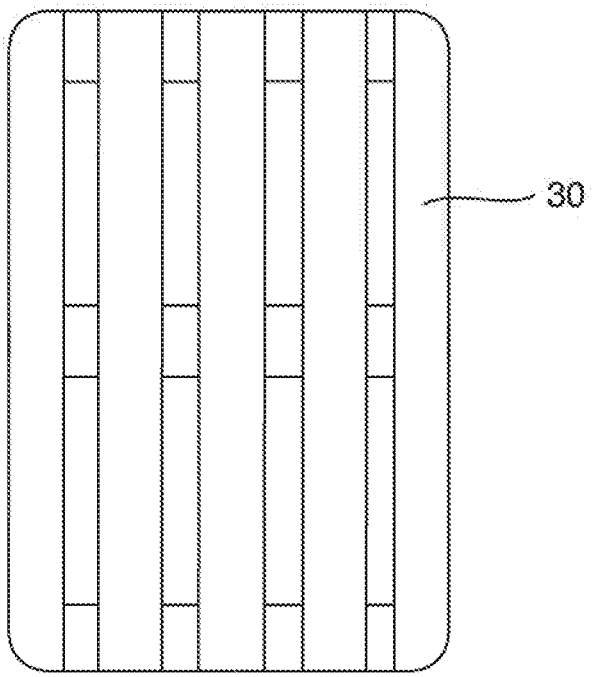
FIG. 3*a*, 3*c* show schematically simplified plan views of a pallet.
Figure 3B:
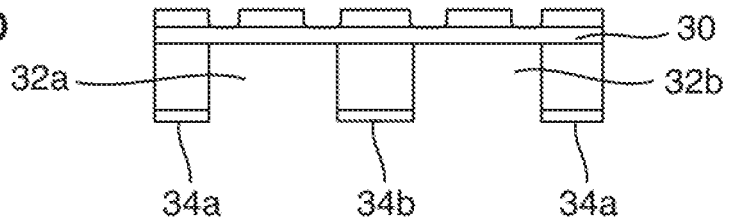
Figure 3C:
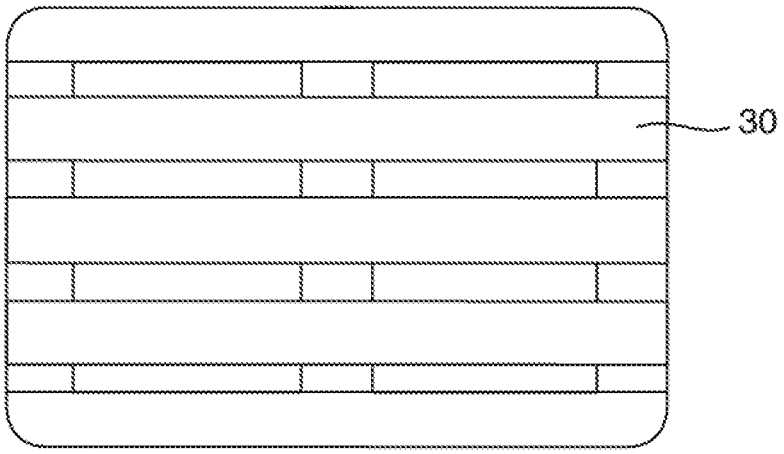
Figure 3D:
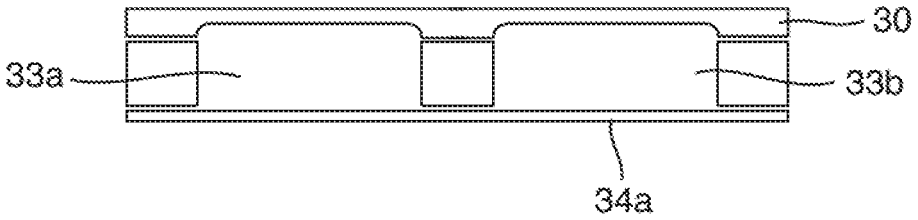

FIG. 3*a* shows a schematically simplified plan view of a pallet 30, and FIG. 3*b* shows the associated side view of the pallet 30. It is a wood pallet only as an example. During longitudinal insertion, the fork tines 6*a*, 6*b* are inserted into the gaps 32*a*, 32*b* visible in this side view. FIG. 3*c* show another schematically simplified plan view of the pallet 30, and FIG. 3*d* shows the associated side view. During transverse insertion, the fork tines 6*a*, 6*b* are inserted into the gaps 33*a*, 33*b*. In this case, the load rollers 8 traverse the first wood plank 34*a* and the second wood plank 34*b*.

Figure 4D:
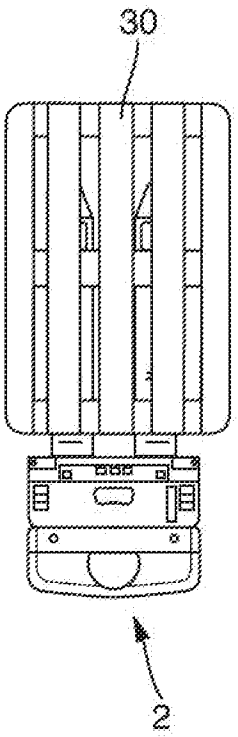
FIGS. 4*a* to 4*d* show a schematically simplified plan view of an industrial truck that is performing a longitudinal insertion into a pallet in different phases during this process.
Figure 4C:
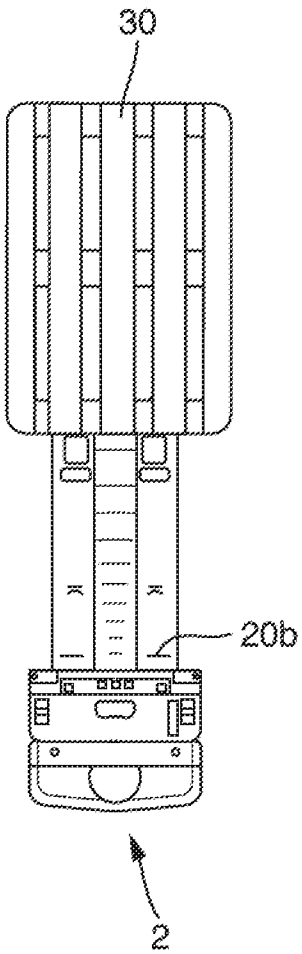
Figure 4B:
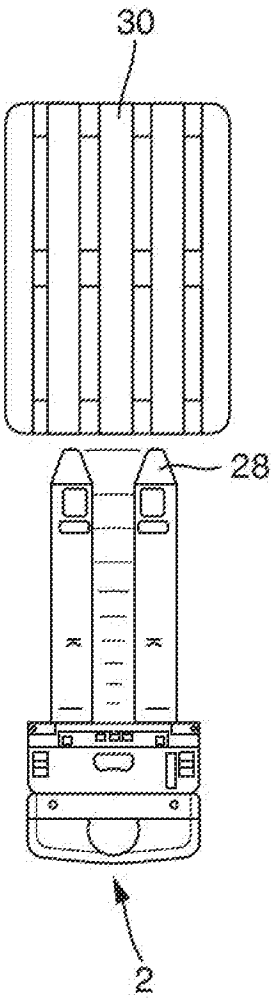
Figure 4A:
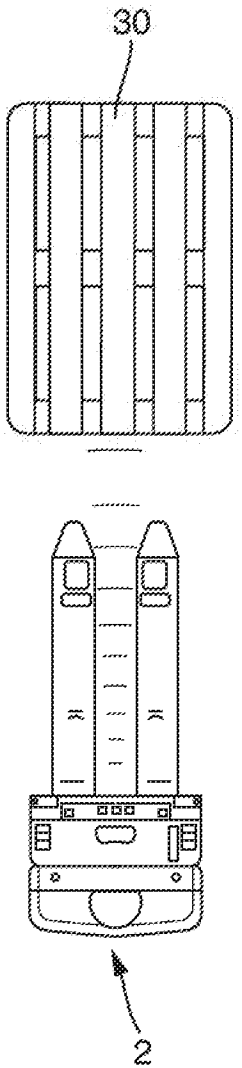

FIGS. 4*a* to 4*d* show a schematically simplified plan view of an industrial truck 2 during a pallet longitudinal insertion in different phases during this process. In FIG. 4*a*, the industrial truck 2 approaches the pallet 30, and the pallet 30 enters into the first detection zone 26*a*. Accordingly, the driving speed of the industrial truck 2 is reduced. At a reduced speed, the industrial truck 2 approaches the pallet 30 until, as shown in FIG. 4*b*, the fork tine tips 28 of the industrial truck 2 enter into the gaps 32*a*, 32*b* in the pallet 30. At that moment, the pallet 30 enters into the second detection zone 26*b*, and the acceleration sensor 24 reads out. Since a vertical acceleration event does not occur during longitudinal insertion because the wood plank 34*a* (see FIG. 3*d*) is not traversed, the processing unit 14 detects a longitudinal insertion and defines the second stop position 20*b* as the stop position for the pallet insertion. This situation is shown in FIG. 4*c*. If the pallet 30 then enters into the third detection zone 26*c*, the driving speed of the industrial truck 2 is further reduced so that it then comes to a stop when the pallet 30 is located at the second stop position 20*b*. This situation is shown in FIG. 4*d*. Upon reaching the second stop position 20*b*, the load that consists of for example the pallet 30 and a commodity loaded thereupon is automatically lifted. It can also be provided that only a visual or acoustic alert signal is output.

Figure 5D:
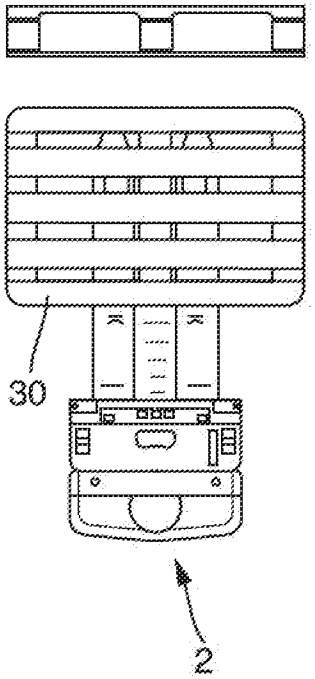
FIGS. 5*a* to 5*d* show a schematically simplified plan view of an industrial truck that is performing a pallet transverse insertion during different phases of this process.
Figure 5C:
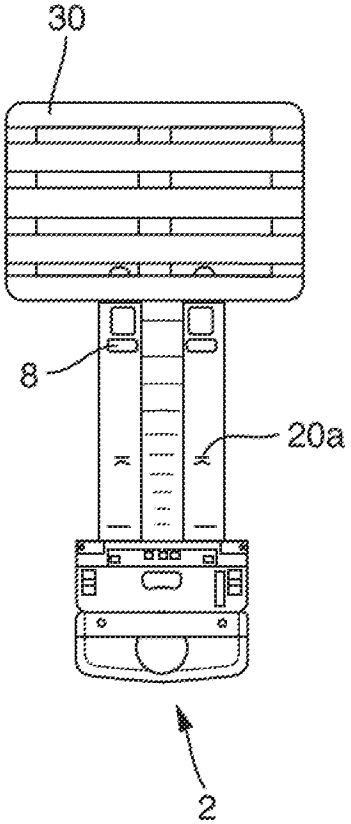
Figure 5B:
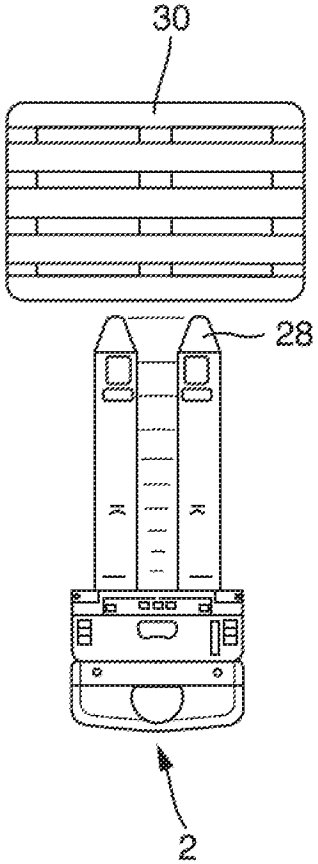
Figure 5A:
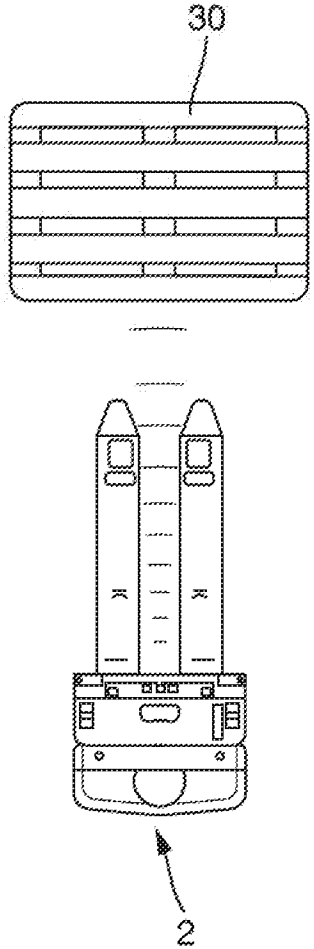
Figure 6A:
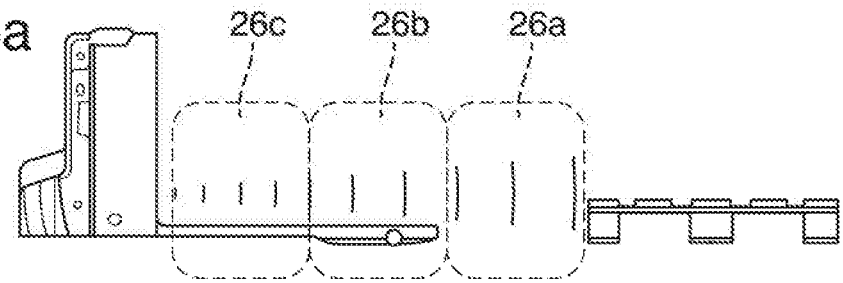
FIGS. 6*a* to 6*d* show a schematically simplified side view of an industrial truck during a pallet transverse insertion.
Figure 6B:
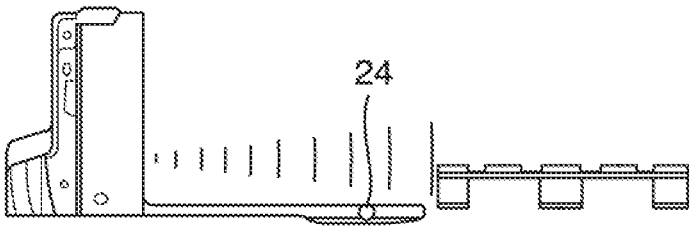
Figure 6C:
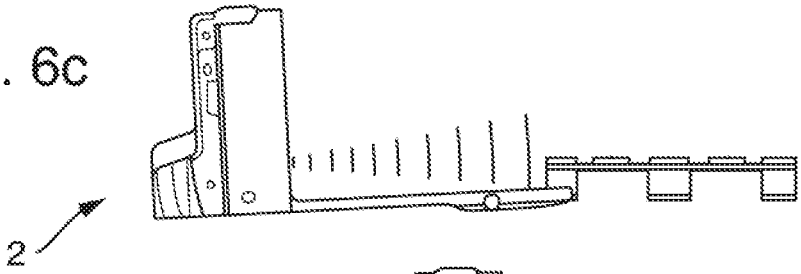
Figure 6D:
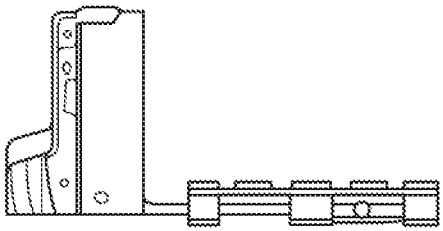

FIGS. 5*a* to 5*d* show other schematically simplified plan views of an industrial truck 2 that is performing a pallet transverse insertion during different phases of this process. The industrial truck 2 approaches the pallet 30, and the load enters into the first detection zone 26*a*. This situation is shown in FIG. 5*a*. The speed of the industrial truck 2 is reduced, and the industrial truck 2 approaches the pallet 30 at a reduced speed. Once the fork tine tips 28 reach the load, they enter into the second detection zone 26*b*; this situation is shown in FIG. 5*b*. The acceleration sensor 24 is read out when the load rollers 8 traverse the first wood plank 34*a* and a vertical acceleration event is detected. This occurs shortly after the position shown in FIG. 5. The presence of the vertical acceleration event causes the first stop position 20*a* to be defined as the stop position and, once the load enters into the third detection zone 26*c*, the industrial truck 2 inserts the fork tines 6*a*, 6*b* into the gaps 33*a*, 33*b* at a reduced speed until the first stop position 20*a* is reached.

FIGS. 6*a* to 6*d* show schematically simplified side views of the industrial truck 2 during the process described in conjunction with FIGS. 5*a* to 5*d*. In this case, the situation in FIG. 6*a* corresponds to the plan view in FIG. 5*a*, the situation in FIG. 6*b* corresponds to the plan view in FIG. 5*b*, etc. The first to third detection zones 26*a*, 26*b* and 26*c* are also represented schematically simplified in FIG. 6*a*.

Figure 7:
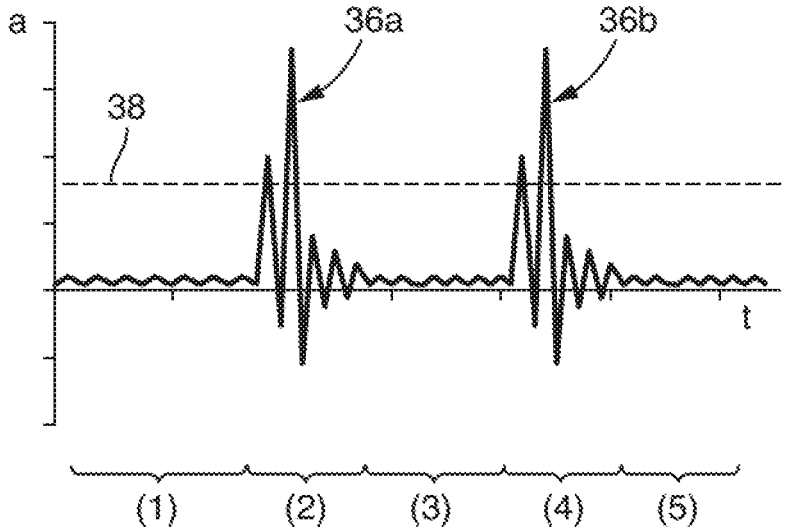
FIG. 7 shows a time-dependent representation of measured values recorded by an acceleration sensor for the vertical acceleration during such a pallet transverse insertion.

FIG. 7 shows a time-dependent representation of measured values recorded by the acceleration sensor 24 for the vertical acceleration during a pallet transverse insertion. The approach to the pallet 30 occurs during the time period (1). During the time period (2), the first wood plank 34*a* of the pallet 30 is traversed; correspondingly, a first vertical acceleration event 36*a* is identified. Such a vertical acceleration event is for example detected with reference to exceeding a set limit value 38 for the vertical acceleration "a". During time period (3), the second wood plank 34*b* of the pallet 30 is approached, and during time period (4), the second wood plank 34*b* is traversed. Correspondingly, a second vertical acceleration event 36*b* occurs. During time period (5), the stop position is approached until the industrial truck 2 stops.

All named features, including those taken from the drawings alone as well as individual features that are disclosed in combination with other features, are considered, alone and in combination, to be essential for the invention. Embodiments according to the invention can be fulfilled by individual features or a combination of several features.

LIST OF REFERENCE CHARACTERS IN DRAWING FIGURES

2 Low-lift industrial truck
4 Load fork
6*a*, 6*b* Fork tine
8 Load roller
10 Housing
12 Front wall

14 Processing unit
16 Distance sensor
18 Shaft front
20*a* First stop position
20*b* Second stop position
22 Output unit
24 Acceleration sensor
26*a* First detection zone
26*b* Second detection zone
26*c* Third detection zone
28 Fork tine tip
30 Pallet
32*a*, 32*b* Gap (pallet longitudinal insertion)
33*a*, 32*b* Gap (pallet transverse insertion)
34*a* First wood plank
34*b* Second wood plank
36*a* First vertical acceleration event
36*b* Second vertical acceleration event
38 Limit value
A Safety distance
GR Fork direction
G1 First limit
G2 Second limit
G3 Third limit

What is claimed is:

1. A low-lift industrial truck for picking up and moving a load, the low-lift industrial truck comprising:

a load fork for picking up the load, said load fork having fork tines with fork tine tips; and a load lifting assistance system that comprises a distance sensor and a processing unit;

wherein fork tines of the load fork each comprise at least one load roller in a region of the fork tine tips, wherein the distance sensor is configured to measure a distance between the load to be picked up by the load fork and a front wall of the industrial truck facing the load fork for processing by the processing unit, wherein at least one distance between the load to be picked up by the load fork and the front wall is saved in the processing unit as a predetermined stop position, wherein the processing unit is configured to generate a stop signal when the distance between the load to be picked up by the load fork and the front wall of the industrial truck facing the load fork measured by the distance sensor corresponds to the predetermined stop position saved in the processing unit, wherein the industrial truck further comprises an acceleration sensor configured to measure a vertical acceleration of the load fork in the region of at least one fork tine tip, wherein the processing unit is configured to process measured values of the acceleration sensor and to detect a presence or absence of a vertical acceleration event, wherein a first distance of a first stop position for pallet transverse insertion and a second distance of a second stop position for pallet longitudinal insertion are saved in the processing unit, and wherein the processing unit is configured to generate the stop signal at the second stop position when:

the distance measured by the distance sensor is less than or equal to the distance of the first stop position; and the presence of the vertical acceleration event is not detected.

2. The industrial truck according to claim 1, wherein the processing unit is further configured to output an alert signal to an acoustic and/or visual output unit when the stop signal is generated.

3. The industrial truck according to claim 1, wherein the processing unit is further configured to stop the industrial truck when the stop signal is generated.

4. The industrial truck according to claim 3, wherein the processing unit is further configured to automatically lift the load fork when the stop signal is generated.

5. The industrial truck according to claim 1, wherein at least one set acceleration parameter characteristic for the vertical acceleration event is saved in the processing unit, and wherein the processing unit is configured to detect the presence of the vertical acceleration event when the at least one set acceleration parameter characteristic is exceeded.

6. The industrial truck according to claim 1, wherein a detection zone is saved in the processing unit, wherein the detection zone extends, at least sectionally, in a fork direction between the first stop position and the fork tine tips, and wherein the processing unit is configured to detect and process measured values of the acceleration sensor when it is determined that the load to be picked up by the load fork is located within the detection zone with reference to the measured distance of the load to be picked up by the load fork.

7. The industrial truck according to claim 6, wherein the load rollers lie at least sectionally within the detection zone.

8. The industrial truck according to claim 6, wherein the detection zone in the fork direction has a length greater than or equal to 227 mm.

9. The industrial truck according to claim 1, wherein detection zone is saved in the processing unit, wherein the detection zone extends in a fork direction starting from the tip region of the fork tines up to a first limit that lies at a safety distance in front of the tip region of the fork tines, and wherein the processing unit is configured to limit a driving speed of the industrial truck to a predetermined value when a measured value of the distance of the load lies within the detection zone.

10. The industrial truck according to claim 1, wherein a detection zone is saved in the processing unit, wherein the detection zone extends in a fork direction starting from a predetermined minimum distance to the front wall, wherein the predetermined stop position lies within the detection zone, and wherein the processing unit is configured to limit a driving speed of the industrial truck to a predetermined value when it is determined that the load is within the detection zone with reference to the measured distance of the load.

11. A method for operating a low-lift industrial truck for picking up a load having a load fork for picking up the load, said load fork having fork tines with fork tine tips and at least one load roller in a region of each of the fork tine tips, the method comprising steps of:

driving the industrial truck at a driving speed in a fork direction toward the load before picking up the load with the load fork; and determining a distance between the load and a front wall of the industrial truck facing the load fork during the driving step with a load lifting assistance system of the industrial truck that comprises a distance sensor and a processing unit, wherein at least one distance between the load and the front wall is saved in the processing unit as a predetermined stop position; and generating a stop signal when the distance determined by the distance sensor in the determining step corresponds to the stop position saved in the processing unit wherein the industrial truck comprises an acceleration sensor configured to measure a vertical acceleration of the load fork in the region of at least one fork tine tip, wherein a first distance of a first stop position for pallet transverse insertion and a second distance of a second stop position for pallet longitudinal insertion are saved in the processing unit, and wherein when a distance is detected that is less than or equal to the distance of the first stop position and a vertical acceleration event is not detected, the stop signal is generated at the second stop position.

12. The method according to claim 11, further comprising outputting an alert signal in an acoustic and/or visual output unit when the stop signal is generated.

13. The method according to claim 11, further comprising stopping the industrial truck when the stop signal is generated.

14. The method according to claim 13, further comprising automatically lifting the load fork when the stop signal is generated.

15. The method according to claim 11, wherein at least one set acceleration parameter characteristic for the vertical acceleration event is saved in the processing unit, and wherein a vertical acceleration event is detected when the at least one set acceleration parameter is exceeded.

16. The method according to claim 11, wherein detection zone is saved in the processing unit, wherein the detection zone extends, at least sectionally, in the fork direction between the first stop position and the fork tine tips, and wherein measured values of the acceleration sensor are detected and processed with respect to the presence or absence of the vertical acceleration event when it is determined that the load is located within the detection zone with reference to the measured distance of the load.

17. The method according to claim 11, wherein a detection zone is saved in the processing unit that extends in the fork direction starting from the fork tine tips up to a first limit that lies at a safety distance in front of the fork tine tips, and when a distance is measured that lies within the detection zone, the driving speed of the industrial truck is limited to a predetermined value.

18. The method according to claim 11, wherein a detection zone is saved in the processing unit that extends in the fork direction starting from a minimum distance to the front wall, wherein the predetermined stop position lies within the detection zone, and wherein the driving speed of the industrial truck is limited to a predetermined value when the distance of the load is determined that lies within the detection zone.

* * * * *